US007879778B2

(12) United States Patent
Poirier et al.

(10) Patent No.: US 7,879,778 B2
(45) Date of Patent: Feb. 1, 2011

(54) SYNTHETIC PHENOLIC ETHER LUBRICANT BASE STOCKS AND LUBRICATING OILS COMPRISING SUCH BASE STOCKS MIXED WITH CO-BASE STOCKS AND/OR ADDITIVES

(75) Inventors: Marc Andre Poirier, Sarnia (CA); Douglas E. Johnson, Cherry Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 397 days.

(21) Appl. No.: 11/821,452

(22) Filed: Jun. 22, 2007

(65) Prior Publication Data

US 2007/0298989 A1 Dec. 27, 2007

Related U.S. Application Data

(60) Provisional application No. 60/816,707, filed on Jun. 27, 2006.

(51) Int. Cl.
*C10M 129/16* (2006.01)

(52) U.S. Cl. ..... 508/580

(58) Field of Classification Search ..... 508/580; 568/640

See application file for complete search history.

(56) References Cited

U.S. PATENT DOCUMENTS

| | | | | |
|---|---|---|---|---|
| 2,504,382 | A | 4/1950 | Bousquet et al. | |
| 2,560,350 | A | 7/1951 | Jelinek | |
| 3,060,243 | A | 10/1962 | Ham | |
| 3,451,061 | A | 6/1969 | Blake et al. | |
| 3,883,601 | A * | 5/1975 | Brindell et al. | 568/640 |
| 4,256,596 | A | 3/1981 | Cohen | |
| 4,513,109 | A * | 4/1985 | Rosenberger | 524/342 |
| 4,897,211 | A * | 1/1990 | Dekura et al. | 508/561 |
| 5,202,040 | A | 4/1993 | Sanderson et al. | |
| 5,254,274 | A | 10/1993 | Ho et al. | |
| 5,368,759 | A | 11/1994 | Horodysky et al. | |
| 5,520,709 | A | 5/1996 | Wei et al. | |
| 5,602,086 | A | 2/1997 | Le et al. | |
| 5,750,480 | A | 5/1998 | Xiong et al. | |
| 6,726,855 | B1 * | 4/2004 | Migdal et al. | 252/401 |
| 7,494,960 | B2 * | 2/2009 | Migdal et al. | 508/497 |
| 2003/0171228 | A1 | 9/2003 | Deckman et al. | |

FOREIGN PATENT DOCUMENTS

| | | | |
|---|---|---|---|
| EP | 0 438 709 | B1 | 12/1990 |
| EP | 0 466 307 | A1 | 1/1992 |
| EP | 0790293 | | 8/1997 |
| GB | 855242 | | 11/1960 |
| GB | 1282 658 | | 7/1972 |
| GB | 2 071 109 | A | 9/1981 |
| JP | 57012097 | | 1/1982 |
| JP | 3370829 | | 1/1997 |
| JP | 09003468 | | 1/1997 |
| JP | 200169867 | A | 6/2000 |

* cited by examiner

*Primary Examiner*—Ellen M McAvoy
(74) *Attorney, Agent, or Firm*—J. J. Allocca

(57) ABSTRACT

High performance base stock, base stock blending component and performance additive comprising bis(hydroxyphenyl)alkyl ethers. Such ethers exhibit superior thermal and oxidation stability, low volatility and superior low temperature properties.

7 Claims, No Drawings

SYNTHETIC PHENOLIC ETHER LUBRICANT BASE STOCKS AND LUBRICATING OILS COMPRISING SUCH BASE STOCKS MIXED WITH CO-BASE STOCKS AND/OR ADDITIVES

This application claims the benefit of U.S. Provisional application 60/816,707 filed Jun. 27, 2006.

BACKGROUND OF THE INVENTION

1. Field of the Invention

The present invention relates to synthetic lubricating oils useful as base stock(s)/base oil(s) per se, as lubricating oil blending components or as additives.

2. Description of the Related Art

Modern engines and other equipment such as gears, transmissions, differentials, compressors, hydraulic equipment, turbines, marine diesels etc. are designed for higher operating temperatures, lower friction, closer machined parts tolerances, and longer periods between servicing, e.g., between lubricant changes.

Such requirements put demands on the lubricating oil which cannot be easily met by traditional mineral oil based lubricants even when highly additized. Mineral oil based lubricants when employed in such high stress environments experience coking, high evaporative loss and insufficient load-carrying performance.

The new performance criteria have led to the development of synthetic lubricants such as polyalphaolefins, alkylated aromatics, alkyl ester stocks, polyol ester stocks and polyphenyl ether.

Polyol esters have good thermal and oxidative stability and low temperature properties but are subject to hydrolysis at high temperature in wet environment, leading to acid production which causes metal corrosion, an increase in lubricant viscosity and a consequential decrease in lubricant service life.

Alkylated aromatics (e.g., alkylated benzene, alkylated naphthalene, alkylated biphenyl etc.) do not hydrolyze and provide very good low temperature properties, excellent solvency, good elastomer compatibility and very good oxidation stability. Alkylated naphthalene has been found to be the alkylated aromatic of choice for use as base stock or blending stock with, e.g., polyalphaolefin to provide significant performance improvements in oxidation stability, solubility, elastomer compatibility, additive solvency and hydrolytic stability (see U.S. Pat. No. 5,602,086). U.S. Pat. No. 5,254,274 discloses the alkylation of aromatic compounds with $C_{20}$ to $C_{1300}$ olefinic hydrocarbon using acidic alkylation catalyst.

Polyphenyl ethers are also known in the art and have higher operating temperatures than other synthetic base stocks but are also characterized by high cost and poor low temperature properties which have limited their usefulness. U.S. Pat. No. 3,451,061 discloses the preparation and use of polyphenyl ethers as functional fluids.

Synthetic lubricating base stock(s)/base oils such as polyalphaolefins are low solvency hydrocarbons because they comprise 100% isoparaffins and 0% aromatic hydrocarbons. Similarly, hydroisomerized or hydrodewaxed waxy hydrocarbons such as slack waxes (i.e., waxes recovered from lubricating oil stocks by solvent dewaxing), waxy raffinate and especially Fischer-Tropsch wax hydroisomerized or hydrodewaxed base oils (also referred to as Gas-to-Liquids (GTL) base stock(s)/base oil(s)) are also highly paraffinic and, depending on the wax source, as in the case of hydroisomerized/isodewaxed Fischer-Tropsch wax base stock/base oil, have essentially zero percent aromatics and/or heteroatom components present and are also characterized by low solvency for solubilizing additives.

U.S. Pat. No. 5,520,709 relates to alkyl ethers of sulfur-containing hydroxyl-derived aromatics that have been found to be effective as high performance synthetic lubricant base stocks with superior catalytic thermal/oxidative stabilities, excellent antiwear and load-carrying properties, as exemplified by bisphenol sulfide based products. These ethers are also highly useful in fuel compositions. In view of some industry specifications limiting the sulfur content in finished lubricants, the presence of sulfur in the molecule and the high cost of the 4,4'-thiodiphenol might limit its utilization of alkyl ethers of sulfur-containing hydroxyl-derived aromatics.

U.S. Pat. No. 5,368,759 discloses an ester-containing reaction product of a carbonyl compound, preferably an acyl halide and a thiodiphenol has high temperature antioxidant properties. The reaction product is useful as synthetic lubricant base fluid or as antioxidant additive when used in minor amounts of 0.01 to 10 wt % in a mineral oil or hydrocracked oil lubricant base fluid. The reaction product can be used in a fuel.

JP 2000 169867 discloses a refrigerating oil composition containing a coolant based as $C_1$-$C_8$ hydrocarbons and a polyether of the formula:

$$R^1—((OR^2)_m—OR^3)_n$$

wherein $R^1$ is an n-valent group having an aromatic nucleus $R^2$ is a $C_2$-$C_6$ polymethylene with one or more hydrogen atoms optionally substituted with a $C_1$-$C_{20}$ alkyl group or a group having the formula $—R^4—(OR^5)_p—OR^6$ wherein $R^4$ is methylene or ethylene, $R^5$ is $C_2$-$C_6$ polymethylene with one or more of hydrogen atoms optionally substituted with a 1-20 carbon alkyl group, $R^6$ is a 1-10 carbon alkyl group or hydrogen, p is 0 to 80, $R^3$ is a 1 to 10 carbon alkyl group or hydrogen n is 1 to 6 and m is a number giving a product of m times n of 3 to 80.

U.S. Pat. No. 5,750,480 discloses a hydrolytically stable lubricating oil exhibiting anti-wear properties, dispersancy, thermal and oxidative stability and a method for producing the lubricating oil. The lubricating oil is a mixture of mono- di- and tri-alkylated anisole having the formula

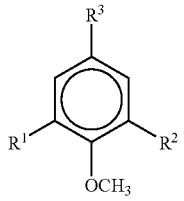

wherein $R^1$, $R^2$ and $R^3$ are hydrogen or a secondary alkyl radical containing 8 to 24 carbon atoms provided all three of $R^1$, $R^2$ and $R^3$ cannot be hydrogen.

JP 3370829B teaches a lubricating oil composition containing a base oil an additive and 0.2 to 8 wt % of a mixed anti-oxidant comprising dialkyldithiocarbamate and aromatic amine. The base oil can be a mixture of polyolesters and alkyl phenyl ether oil. The lubricating oil can also be turned into a grease by addition of thickeners. The alkyl phenyl ether oil can be alkyl diphenyl ether, alkyl polyphenyl ether, dialkyl tetraphenyl ether and the like.

EP 0 466 307 is directed to synthetic lubricant base oils comprising oligomers prepared by reacting over a catalyst a $C_{10}$ to $C_{24}$ linear olefin with an alkyl substituted diphenyl, diphenyl ether or anisole.

EP 0 438 709 teaches an engine oil containing up to 10 wt % of an alkylphenol alkoxylate, or of a bisphenol alkoxylate $$R^1[O(R^2O)_nH]_m \quad \text{I}$$

II

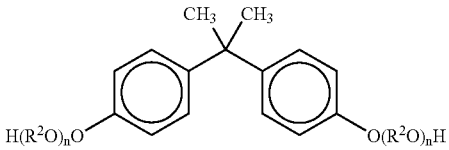

wherein $R^1$ is a radical of an alkylphenol having up to 2 alkyl groups of 6 to 24 carbon atoms or a bisphenol, $R^2$ is the radical of butylene oxide alone or a mixture with propylene oxide, n is from 10 to 1000, and m is 1 or 2. When $R^1$ is Bisphenol A the product can be the material of Formula II (provided m is 2).

JP 57012097 teaches a base oil for lubrication of metal containing polyoxyalkylene ether of Bisphenol A or Bisphenol B, i.e., materials of the formula

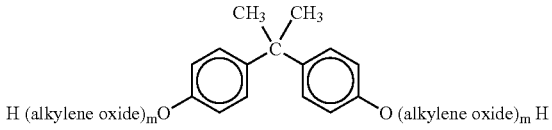

The base oil is described as having numerous advantages, including no generation of sludge, being non-corrosive to rubber and metal, having a relatively high flash point, high viscosity index, soluble in water, low toxicity, superior heat resistance.

U.S. Pat. No. 4,256,596 teaches a composition useful as lubricant or fuel additive produced by the oxidative coupling of a mixture of (a) at least one hydroxy aromatic compound containing no aliphatic substituents with more than 4 carbon atoms and (b) at least one hydroxyaromatic component containing at least one aliphatic substituent with at least 12 carbon atoms. At least one position ortho to an OH group in each of (a) and (b) must be unsubstituted. Each of (a) and (b) further contain X and Y groups which can be H, halo, R, ROH OR, SR, RCl wherein R is up to 4 carbons.

U.S. Pat. No. 3,451,061 teaches poly(m-oxyphenylene) benzenes a functional fluid. The materials are unsubstituted aromatic ethers of the general formula

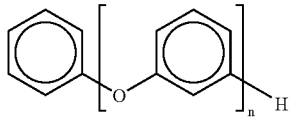

U.S. Pat. No. 3,060,243 teaches the preparation of materials of the formula 2,2-bis(para-alkenyloxyphenyl) propane

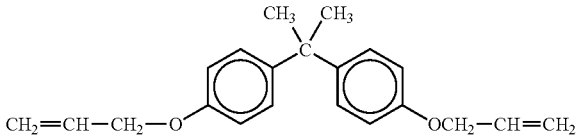

U.S. Pat. No. 2,560,350 teaches 2,2-bis(para alkyloxyphenyl) propane as an insecticide.

U.S. Pat. No. 2,504,382 teaches miticidal compositions comprising 2,2-bis(para-alkoxyphenyl) propane, which are materials of the formula

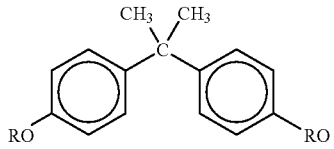

wherein Rs are alkyl groups containing from 1 to 4 carbon atoms.

DESCRIPTION OF THE PRESENT INVENTION

The present invention is directed to a lubricant which comprises a base stock/base oil comprising a synthetic phenolic ether of the formula (A)

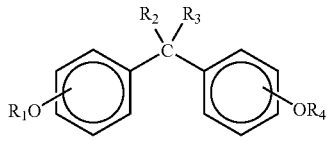

wherein $R_1$ and $R_4$ are the same or different and are H, or alkyl hydrocarbyl groups containing 1 to 16 carbons, preferably $C_3$ to $C_{16}$ linear or branched alkyl group, more preferably $C_3$ to $C_{12}$ linear or branched alkyl groups, preferably $R_1$ and $R_4$ are different and provided that both $R_1$ and $R_4$ cannot be H and that if either is H it constitutes less than 5% of the total of the $R_1$ and $R_4$ groups; $R_2$ and $R_3$ are the same or different and are hydrogen or 1 to 3 carbon alkyl groups, preferably methyl groups.

The present invention is also directed to lubricating oil formulations comprising mixtures of the synthetic phenol ether base stock(s)/base oil(s) of Formula A mixed with a second base oil selected from mineral oil, synthetic oil and nonconventional oil, preferably synthetic oils such as polyalphaolefins and nonconventional base stock and/or base oils, the nonconventional base stock(s) and/or base oil(s) being exemplified by Gas-to-Liquids (GTL) base stock and/or base oil, hydrodewaxed or hydroisomerized/catalytic (and/or solvent) dewaxed waxy feeds such as slack wax, foots oil, waxy raffinate, and Fischer-Tropsch waxes, to produce a base stock and/or base oil.

The present invention is also directed to a method for lubricating equipment requiring lubrication by introducing into the equipment a lubricant which comprises a base stock/base oil comprising a synthetic phenolic ether of the Formula A or a lubricant comprising a mixture of the synthetic phenolic ether of Formula A mixed with a second base stock and/or base oil and/or an additive effective amount one or more performance additives.

Lubricating base oil mixtures of the present invention comprises (a) from about 1 to 25 wt %, preferably 3 to 20 wt %, more preferably 5 to 10 wt % of the synthetic phenol ether of Formula A and the balance being the second base oil comprising one or more of mineral oil, synthetic oil and nonconventional oil, preferably synthetic oil such as PAO and nonconventional oil such as one or more GTL base stock and/or base, oil, hydrodewaxed or hydroisomerized/catalytic (and/or solvent) dewaxed waxy feeds such as slack wax, foots oil, waxy raffinate, Fischer-Tropsch (F-T) wax, most preferably GTL base stock and/or base oil and/or hydrodewaxed or hydroisomerized/catalytic (and/or solvent) dewaxed waxy feed base stock and/or base oil.

The mixture can also contain from about 1 to about 10 wt % of a long chain alkyl aromatic as the second base stock or as an additional base stock such as alkylated naphthalene, e.g., $C_6$-$C_{20}$ alkyl naphthalene, or $C_6$-$C_{20}$ alkyl methyl naphthalene.

The methods for the preparation of ethers are well known. The phenolic ethers of the Examples of this invention were prepared by the reaction of Bisphenol A with a mixture of hydrocarbyl halides. Suitable hydrocarbyl halides include but not limited to n-butyl bromide, 2-methylbutyl bromide, 2-butyl bromide, 3-methylbutyl bromide, n-hexyl bromide, 3-methylphentyl bromide, 2-ethylhexyl bromide, n-octyl bromide, cyclohexyl bromide, decyl bromide and the like. The corresponding hydrocarbyl chlorides can also be used. Other suitable hydrocarbyl derivatives are known to those skilled in the art.

A phase transfer catalyst may also be used. Suitable phase transfer catalyst are used to increase the reaction yield and comprise of but not limited to quaternary ammonium halides such as tetramethyammonium bromide, tetraethylammonium bromide, tetrapropylammonium bromide, tetrabutylammonium bromide, tricaprylmethylammonium bromide and the like. The corresponding tetraalkylammonium chlorides can also be used.

The phenolic ethers of this invention can also be prepared by the reaction of the Bisphenols with a mixture of trialkyl orthoformates on an acidic ion exchange resin. This method is particularly suitable for large production of the phenolic ethers as it minimizes the formation of waste products. The alkyl groups on the orthoformates can be same or different and selected from the groups methyl ethyl, n-propyl, isopropyl, butyl, isobutyl, tert-butyl, amyl, 3-methyl-1-butyl, 2-methyl-1-butyl, n-hexyl, 4-methyl-1-pentyl, 3-methyl-1-pentyl, 2-methyl-1-pentyl, cyclohexyl, n-heptyl, 5-methyl-1-hexyl, 4-methyl-1-hexyl, n-octyl, iso-octyl, 2-ethyl-1-hexyl, n-nonyl, dodecyl, undecyl, decadecyl, tridecyl, tetradecyl, pentadecyl, hexadecyl and the like.

The phenolic ethers of this invention can be used as an additive in or as a lubricant base stock in engine oils, marine lubricants, industrial oils, gear oils, compressor oils, hydraulic oils, diesel automotive oils and other lubricant applications. The phenolic ethers of this invention are excellent solvents for polar additives such as antiwear additives, antioxidants, demulsifiers, extreme pressure additives, dispersants, detergents, VI improvers, antifoam agents, corrosion inhibitors and the like.

The phenol ethers of this invention are useful as base stocks/base oils per se and as co-base stocks and/or as additives in engine oils (gasoline and diesel), marine lubricants, industrial oils, gear oils, compressor oils, hydraulic oils, gas engine oils, and other lubricant applications such as greases.

The unexpected utility of the synthetic phenolic ethers is based on the discovery of their unexpected superior thermal and oxidative stability, better solvency characteristics, and lower volatility as compared to other synthetic material, such as alkylated naphthalene or PAO, as well as their possession of is good low temperature properties.

Solvency properties are typically measured by the Aniline Point (ASTM D611). Low aniline point (0 to 10° C.) co-base stocks such as polyol esters have excellent solvency but are quite aggressive/detrimental to seals. It has unexpectedly been found that the synthetic phenol ethers have low aniline points (<0° C.) similar to those of the polyol esters but have the good seal compatibility of the alkylated naphthalenes which have higher aniline points.

Lubricating oil formulations comprising the synthetic phenol ethers of this invention typically contain either one or more of a second base oil or co-base stock and/or an additive effective amount of one or more performance additives.

The one or more of a second base oil is selected from mineral oil, non-petroleum hydrocarbon oils, synthetic oils and nonconventional base oils.

A wide range of lubricating base stock(s)/base oils is known in the art. Base stock is defined as a lubricant component produced by a single manufacturer to the same specifications (independent of feed source or manufacturer's location) that meets a given manufacturer's particular specification regardless of manufacturing technique or process. A base oil is the particular base stock or mixtures of base stocks meeting the specification requirements of a particular finished lubricating oil product. Lubricating base stocks/base oils that are useful in the present invention as second base oils or co-base stock oils are natural oils, synthetic oils, and nonconventional oils of lubricating viscosity, typically those oils having a Kinematic Viscosity (KV) at 100° C. (as measured by ASTM D445) in the range of about 2 to 100 $mm^2/s$, preferably about 2 to 50 $mm^2/s$, more preferably about 4 to 25 $mm^2/s$. Natural oil, synthetic oils, and nonconventional oils and mixtures thereof can be used unrefined, refined, or rerefined (the latter is also known as reclaimed or reprocessed oil). Unrefined oils are those obtained directly from a natural, synthetic or nonconventional source and used without further purification. These include for example shale oil obtained directly from retorting operations, petroleum oil obtained directly from primary distillation, and ester oil obtained directly from an esterification process. Refined oils are similar to the oils discussed for unrefined oils except refined oils are subjected to one or more purification or transformation steps to improve at least one lubricating oil property. One skilled in the art is familiar with many purification or transformation processes. These processes include, for example, solvent extraction, secondary distillation, acid extraction, base extraction, filtration, percolation, hydrogenation, hydrorefining, and hydrofinishing. Rerefined oils are obtained by processes analogous to refined oils, but employ an oil that has been previously used.

Groups I, II, III, IV and V are broad categories of base oil stocks developed and defined by the American Petroleum Institute (API Publication 1509; www.API.org). Group I base stocks have a viscosity index of between 80 to 120 and contain greater than 0.03% sulfur and/or less than 90% saturates. Group II base stocks have a viscosity index of between 80 to 120, and contain less than or equal to 0.03% sulfur and greater than or equal to 90% saturates. Group III base stocks have a viscosity index greater than 120 and contains less than or equal to 0.03% sulfur and greater than 90% saturates. Group IV includes polyalphaolefins (PAO). Group V base stocks include base stocks not included in Groups I-IV. Table A summarizes properties of each of these five groups.

TABLE A

| Base Stock Properties | | | |
|---|---|---|---|
| | Saturates | Sulfur | Viscosity Index |
| Group I | <90% and/or | >0.03% and | ≧80 and <120 |
| Group II | ≧90% and | ≦0.03% and | ≧80 and <120 |
| Group III | ≧90% and | ≦0.03% and | ≧120 |
| Group IV | Polyalphaolefins (PAO) | | |
| Group V | All other base oil stocks not included in Groups I, II, III, or IV | | |

Natural oils include animal oils (lard oil, for example), vegetable oils (castor oil and olive oil, for example), and mineral oils. Animal and vegetable oils possessing favorable thermal-oxidative stability can be used. Of the natural oils, mineral oils are preferred. Mineral oil compositions vary widely as to their crude source, for example, as to whether they are paraffinic, naphthenic, or mixed paraffinic-naphthenic. Oils derived from coal or oil shale are also useful in the present invention. Natural oils vary also as to the method used for their production and purification, for example, their distillation range and whether they are straight run or cracked, hydrorefined, or solvent extracted.

Synthetic oils include hydrocarbon oils as well as non-hydrocarbon oils. Synthetic oils can be derived from processes such as chemical combination (for example, polymerization, oligomerization, condensation, alkylation, acylation, etc.), where materials consisting of smaller, simpler molecular species are built up (i.e., synthesized) into materials consisting of larger, more complex molecular species. Synthetic oils include hydrocarbon oils such as polymerized and interpolymerized olefins (polybutylenes, polypropylenes, propylene isobutylene copolymers, ethylene-olefin copolymers, and ethylene-alpha-olefin copolymers, for example). Polyalphaolefin (PAO) oil base stock is a commonly used synthetic hydrocarbon oil. By way of example, PAOs derived from $C_8$, $C_{10}$, $C_{12}$, $C_{14}$ olefins or mixtures thereof may be utilized. See U.S. Pat. No. 4,956,122; U.S. Pat. No. 4,827,064; and U.S. Pat. No. 4,827,073.

The number average molecular weights of the PAOs, which are known materials and generally available on a major commercial scale from suppliers such as ExxonMobil Chemical Company, Chevron-Phillips, BP-Amoco, and others, typically vary from about 250 to about 3000, or higher, and PAOs may be made in kinematic viscosities up to about 100 cSt (measured at 100° C.), or higher. In addition, higher viscosity PAOs are commercially available, and may be made in kinematic viscosities up to about 3000 cSt (measured at 100° C.), or higher. The PAOs are typically comprised of relatively low molecular weight hydrogenated polymers or oligomers of alphaolefins which include, but are not limited to, about $C_2$ to about $C_{32}$ alphaolefins with about $C_8$ to about $C_{16}$ alphaolefins, such as 1-octene, 1-decene, 1-dodecene and the like, being preferred. The preferred polyalpha-olefins are poly-1-octene, poly-1-decene and poly-1-dodecene and mixtures thereof and mixed olefin-derived polyolefins. Depending on the viscosity grade and the starting oligomer, the PAOs may be predominantly trimers and tetramers of the starting olefins, with minor amounts of the higher oligomers, having a viscosity range of about 1.5 to 12 $mm^2/s$. However, the dimers of higher olefins in the range of about $C_{1-4}$ to $C_{18}$ may be used to provide low viscosity base stocks of acceptably low volatility.

PAO fluids may be conveniently made by the polymerization of an alphaolefin in the presence of a polymerization catalyst such as the Friedel-Crafts catalyst including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330, also incorporated herein.

Other useful synthetic lubricating base stock oils such as silicon-based oil or esters of phosphorus-containing acids may also be utilized. Examples of other synthetic lubricating base stocks are the seminal work "Synthetic Lubricants", C. R. Gunderson and W. A. Hart, Reinhold Publishing Corp., New York, N.Y. 1962.

In alkylated aromatic stocks, the alkyl substituents are typically alkyl groups of about 8 to 25 carbon atoms, usually from about 10 to 18 carbon atoms and up to about three such substituents may be present, as described for the alkyl benzenes in ACS Petroleum Chemistry Preprint 1053-1058, "Poly n-Alkylbenzene Compounds: A Class of Thermally Stable and Wide Liquid Range Fluids", K. C. Eapen et al, Philadelphia 1984. Tri-alkyl benzenes may be produced by the cyclodimerization of 1-alkynes of 8 to 12 carbon atoms as described in U.S. Pat. No. 5,055,626. Other alkylbenzenes are described in European Patent Application No. 168 534 and U.S. Pat. No. 4,658,072. Alkylbenzenes are used as lubricant base stocks, especially for low-temperature applications (arctic vehicle and machinery service, and refrigeration oils) and in papermaking oils. They are commercially available from producers of linear alkylbenzenes (LABs) such as Vista Chemical Co, Huntsman Chemical Co., Chevron Chemical Co., and Nippon Oil Co. Linear alkylbenzenes typically have good low pour points, low temperature viscosities, and VI values greater than about 100, together with good solvency for additives. Other alkylated aromatics which may be used when desirable are described, for example, in "Synthetic Lubricants and High Performance Functional Fluids", H. Dressler, Chapter 5, (R. L. Shubkin (Ed.)), Marcel Dekker, New York, N.Y. (1993).

Alkylene oxide polymers and interpolymers and their derivatives containing modified terminal hydroxy groups obtained by, for example, esterification or etherification are useful synthetic lubricating oils. By way of example, these oils may be obtained by polymerization of ethylene oxide, propylene oxide or other alkylene oxides. The alkyl and aryl ethers of these polyoxyalkylene polymers (methyl-polyisopropylene glycol ether having an average molecular weight of about 1000, diphenyl ether of polyethylene glycol having a molecular weight of about 500-1000, and the diethyl ether of polypropylene glycol having a molecular weight of about 1000 to 1500, for example) or mono- and poly-arboxylic esters thereof (the acidic acid esters, mixed $C_{3-8}$ fatty acid esters, or the $C_{13}$Oxo acid diester of tetraethylene glycol, for example) can be used as lubricant base stocks.

Esters comprise a useful base stock/base oil. Additive solvency and seal swell characteristics may be secured by the use of esters such as the esters of dibasic acids with monoalkanols and the polyol esters of mono-carboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols such as the neopentyl polyols e.g. neopentyl glycol, trimethylol ethane, 2-methyl-2-propyl-1,3-propanediol, trimethylol propane, pentaerythritol and dipentaerythritol, with alkanoic acids containing at least about 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid.

Suitable synthetic ester base stock components include the esters of trimethylol propane, trimethylol butane, trimethylol ethane, pentaerythritol and/or dipenta-erythritol with one or more monocarboxylic acids containing from about 5 to about 10 carbon atoms.

Silicon-based oils are another class of useful synthetic lubricating oils. These oils include polyalkyl-, polyaryl-, polyalkoxy-, and polyaryloxy-siloxane oils and silicate oils. Examples of suitable silicon-based oils include tetraethyl silicate, tetraisopropyl silicate, tetra-(2-ethylhexyl)silicate, tetra-(4-methylhexyl) silicate, tetra-(p-tert-butylphenyl) silicate, hexyl-(4-methyl-2-pentoxy) disiloxane, poly(methyl) siloxanes, and poly-(methyl-2-methylphenyl) siloxanes.

Another class of synthetic lubricating oil is esters of phosphorous-containing acids. These include, for example, tricresyl phosphate, trioctyl phosphate, the diethyl ester of decanephosphonic acid.

Another class of oils includes polymeric tetrahydrofurans, their derivatives, and the like.

In the present invention it is preferred that the second base stock/base oil or co-base stock be an isoparaffinic, predominantly saturated base oil/base stock. Useful fluids of lubricating viscosity meeting this requirement include non-conventional or unconventional base oils that have been processed, preferably catalytically, or synthesized to provide high performance lubrication characteristics as described below.

Non-conventional or unconventional base stocks and/or base oils include one or more of a mixture of base stock(s) and/or base oil(s) derived from one or more Gas-to-Liquids (GTL) materials, as well as hydrodewaxed, or hydroisomerized/cat (and/or solvent) dewaxed base stock(s) and/or base oils derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks and/or base oils.

As used herein, the following terms have the indicated meanings:

a) "wax"—hydrocarbonaceous material having a high pour point, typically existing as a solid at room temperature, i.e., at a temperature in the range from about 15° C. to 25° C., and consisting predominantly of paraffinic materials;

b) "paraffinic" material: any saturated hydrocarbons, such as alkanes. Paraffinic materials may include linear alkanes, branched alkanes (isoparaffins), cycloalkanes (cycloparaffins; mono-ring and/or multi-ring), and branched cycloalkanes;

c) "hydroprocessing": a refining process in which a feedstock is heated with hydrogen at high temperature and under pressure, commonly in the presence of a catalyst, to remove and/or convert less desirable components and to produce an improved product;

d) "hydrotreating": a catalytic hydrogenation process that converts sulfur- and/or nitrogen-containing hydrocarbons into hydrocarbon products with reduced sulfur and/or nitrogen content, and which generates hydrogen sulfide and/or ammonia (respectively) as byproducts; similarly, oxygen containing hydrocarbons can also be reduced to hydrocarbons and water;

e) "catalytic dewaxing": a conventional catalytic process in which normal paraffins (wax) and/or waxy hydrocarbons, e.g., slightly branched isoparaffins, are converted by cracking/fragmentation into lower molecular weight species to insure that the final oil product (base stock or base oil) has the desired product pour point;

f) "solvent dewaxing": a process whereby wax is physically removed from oil by use of chilled solvent or an autorefrigerative solvent to solidify the wax which can then be removed from the oil;

g) "hydroisomerization" (or isomerization): a catalytic process in which normal paraffins (wax) and/or slightly branched iso-paraffins are converted by rearrangement/isomerization into branched or more branched isoparaffins (the isomerate from such a process possibly requiring a subsequent additional wax removal step to ensure that the final oil product (base stock or base oil) has the desired product pour point);

h) "hydrocracking": a catalytic process in which hydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

i) "hydrodewaxing": (e.g., ISODEWAXING® of Chevron or MSDW™ of Exxon Mobil corporation) a very selective catalytic process which in a single step or by use of a single catalyst or catalyst mixture effects conversion of wax by isomerization/rearrangement of the n-paraffins and slightly branched isoparaffins into more heavily branched isoparaffins, the resulting product not requiring a separate conventional catalytic or solvent dewaxing step to meet the desired product pour point;

j) the terms "hydroisomerate", "isomerate", "catalytic dewaxate", and "hydrodewaxate" refer to the products produced by the respective processes, unless otherwise specifically indicated;

k) "base stock" is a single oil secured from a single feed stock source and subjected to a single processing scheme and meeting a particular specification;

l) "base oil" comprises one or more base stock(s).

Thus the term "hydroisomerization/cat dewaxing" is used to refer to catalytic processes which have the combined effect of converting normal paraffins and/or waxy hydrocarbons by rearrangement/isomerization, into more branched iso-paraffins, followed by (1) catalytic dewaxing to reduce the amount of any residual n-paraffins or slightly branched iso-paraffins present in the isomerate by cracking/fragmentation or by (2) hydrodewaxing to effect further isomerization and very selective catalytic dewaxing of the isomerate, to reduce the product pour point. When the term "(and/or solvent)", is included in the recitation, the process described involves hydroisomerization followed by is solvent dewaxing (or a combination of solvent dewaxing and catalytic dewaxing) which effects the physical separation of wax from the hydroisomerate so as to reduce the product pour point.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) and/or base oil(s) include oils boiling in the lube oil boiling range separated/fractionated from synthesized GTL materials such as for example, by distillation and subsequently subjected to a final wax processing step which is either or both of the well-known catalytic dewaxing process, or solvent dewaxing process, to produce lube oils of reduced/low pour point; synthesized wax isomerates, comprising, for example, hydrodewaxed, or hydroisomerized/cat (and/or solvent) dewaxed synthesized waxy hydrocarbons; hydrodewaxed, or hydroisomerized/cat (and/or solvent) dewaxed Fischer-Tropsch (F-T) material (i.e., hydrocarbons, waxy hydrocarbons, waxes and possible analogous oxygenates); preferably hydrodewaxed, or hydroisomerized/cat (and/or solvent) dewaxed F-T hydrocarbons, or hydrodewaxed or hydroisomerized/cat (or solvent) dewaxed, F-T waxes, hydrodewaxed, or hydroisomerized/cat (and/or solvent) dewaxed synthesized waxes, or mixtures thereof.

GTL base stock(s) and/or base oil(s) derived from GTL materials, especially, hydrodewaxed, or hydroisomerized/cat (and/or solvent) dewaxed F-T material derived base stock(s) and/or base oil(s), and other hydrodewaxed, or hydroisomerized/cat (and/or solvent) dewaxed wax derived base stock(s) and/or base oil(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the hydrodewaxing or hydroisomerization/catalytic (or solvent dewaxing) of F-T wax, which has a kinematic viscosity of about 4 $mm^2/s$ at 100° C. and a viscosity index of about 130 or greater. Preferably the wax treatment process is hydrodewaxing carried out in a process using a single hydrodewaxing catalyst. Reference herein to Kinematic viscosity refers to a measurement made by ASTM method D445.

GTL base stock(s) and/or base oil(s) derived from GTL materials, especially hydrodewaxed, or hydroisomerized/cat (and/or solvent) dewaxed F-T material derived base stock(s) and/or base oil(s), and other hydrodewaxed, or hydroisomerized/cat (and/or solvent) dewaxed wax-derived base stock(s) and/or base oil(s), which can be used as base stock and/or base oil components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. References herein to pour point refer to measurement made by ASTM D97 and similar automated versions.

The GTL base stock(s) and/or base oil(s) derived from GTL materials, especially hydrodewaxed or hydroisomerized/cat (and/or solvent) dewaxed F-T material derived base stock(s) and/or base oil(s), and other such wax-derived base stock(s) and/or base oil(s) which can be used in this invention are also characterized typically as having viscosity indices of 80 or greater, preferably 100 or greater, and more preferably 120 or greater. Additionally, in certain particular instances, the viscosity index of these base stocks and/or base oil(s) may be preferably 130 or greater, more preferably 135 or greater, and even more preferably 140 or greater. For example, GTL base stock(s) and/or base oil(s) that derive from GTL materials preferably F-T materials especially F-T wax generally have a viscosity index of 130 or greater. References herein to viscosity index refer to ASTM method D2270.

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained by the hydroisomerization/isodewaxing of F-T material, especially F-T wax, is essentially nil.

In a preferred embodiment, the GTL base stock(s) and/or base oil(s) comprises paraffinic materials that consist predominantly of non-cyclic isoparaffins and only minor amounts of cycloparaffins. These GTL base stock(s) and/or base oil(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s) and/or base oil(s), hydrodewaxed or hydroisomerized/cat (and/or solvent) dewaxed F-T material derived base stock(s), and wax-derived hydrodewaxed, or hydroisomerized/cat (and/or solvent) dewaxed base stock(s), such as wax isomerates or hydrodewaxates, are recited in U.S. Pat. Nos. 6,080,301; 6,090,989, and 6,165,949 for example.

Base stock(s) and/or base oil(s) derived from waxy feeds, which are also suitable for use in this invention, are paraffinic fluids of lubricating viscosity derived from hydrodewaxed, or hydroisomerized/cat (and/or solvent) dewaxed waxy feedstocks of mineral oil, non-mineral oil, non-petroleum, or natural source origin, e.g., feedstocks such as one or more of gas oils, slack wax, waxy fuels hydrocracker bottoms, hydrocarbon raffinates, natural waxes, hyrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stock(s) and/or base oil(s).

Slack wax is the wax recovered from any waxy hydrocarbon oil including synthetic oil such as F-T waxy oil or petroleum oils by solvent or autorefrigerative dewaxing. Solvent dewaxing employs chilled solvent such as methyl ethyl ketone (MEK), methyl isobutyl ketone (MIBK), mixtures of MEK/MIBK, mixtures of MEK and toluene, while autorefrigerative dewaxing employs pressurized, liquefied low boiling hydrocarbons such as propane or butane.

Slack wax(es) secured from synthetic waxy oils such as F-T waxy oil will usually have zero or nil sulfur and/or nitrogen containing compound content. Slack wax(es) secured from petroleum oils, may contain sulfur and nitrogen containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

The term GTL base stock and/or base oil and/or hydrodewaxate base stock and/or base oil and/or wax isomerate base stock and/or base oil as used herein and in the claims is to be understood as embracing individual fractions of GTL base stock and/or base oil and/or of wax-derived hydrodewaxed or hydroisomerized/cat (and/or solvent) dewaxed base stock and/or base oil as recovered in the production process, mixtures of two or more GTL base stock and/or base oil fractions and/or wax-derived hydrodewaxed, or hydroisomerized/cat (and/or solvent) dewaxed base stocks/base oil fractions, as well as mixtures of one or two or more low viscosity GTL base stock and/or base oil fraction(s) and/or wax-derived hydrodewaxed, or hydroisomerized/cat (and/or solvent) dewaxed base stock and/or base oil fraction(s) with one, two or more higher viscosity GTL base stock and/or base oil fraction (s) and/or wax-derived hydrodewaxed, or hydroisomerized/cat (and/or solvent) dewaxed base stock and/or base oil fraction(s) to produce a dumbbell blend wherein the blend exhibits a kinematic viscosity within the aforesaid recited range.

In a preferred embodiment, the GTL material, from which the GTL base stock(s) and/or base oil(s) is/are derived is an F-T material (i.e., hydrocarbons, waxy hydrocarbons, wax). A slurry F-T synthesis process may be beneficially used for synthesizing the feed from CO and hydrogen and particularly one employing an F-T catalyst comprising a catalytic cobalt component to provide a high Schultz-Flory kinetic alpha for producing the more desirable higher molecular weight paraffins. This process is also well known to those skilled in the art.

In an F-T synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid. The stoichiometric mole ratio for a F-T synthesis reaction is 2.0, but there are many reasons for using other than a stoichiometric ratio as those skilled in the art know. In cobalt slurry hydrocarbon synthesis process the feed mole ratio of the $H_2$ to CO is typically about 2.1/1. The synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used. Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$-$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320-850° F., 80-600 psi and 100-40,000 V/hr/V, expressed as standard volumes of the gaseous CO and $H_2$ mixture (0° C., 1 atm) per hour per volume of catalyst, respectively. The term "$C_{5+}$" is used herein to refer to hydrocarbons with a carbon number of greater than 4, but does not imply that material with carbon number 5 has to be present. Similarly other ranges quoted for carbon number do not imply that hydrocarbons having the limit values of the carbon is number range have to be present, or that every carbon number in the quoted range is present. It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable F-T reaction types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise Titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above, the waxy feed from which the base stock(s) and/or base oil(s) is/are derived is a wax or waxy feed from mineral oil, non-mineral oil, non-petroleum, or other natural source, especially slack wax, or GTL material, preferably F-T material, referred to as F-T wax. F-T wax preferably has an initial boiling point in the range of from 650-750° F. and preferably continuously boils up to an end point of at least 1050° F. A narrower cut waxy feed may also be used during the hydroisomerization. A portion of the n-paraffin waxy feed is converted to lower boiling isoparaffinic material. Hence, there must be sufficient heavy n-paraffin material to yield an isoparaffin containing isomerate boiling in the lube oil range. If catalytic dewaxing is also practiced after isomerization/isodewaxing, some of the isomerate/isodewaxate will also be hydrocracked to lower boiling material during the conventional catalytic dewaxing. Hence, it is preferred that the end boiling point of the waxy feed be above 1050° F. (1050° F.+).

When a boiling range is quoted herein it defines the lower and/or upper distillation temperature used to separate the fraction. Unless specifically stated (for example, by specifying that the fraction boils continuously or constitutes the entire range) the specification of a boiling range does not require any material at the specified limit has to be present, rather it excludes material boiling outside that range.

The waxy feed preferably comprises the entire 650-750° F.+ fraction formed by the hydrocarbon synthesis process, having an initial cut point between 650° F. and 750° F. determined by the practitioner and an end point, preferably above 1050° F., determined by the catalyst and process variables employed by the practitioner for the synthesis. Such fractions are referred to herein as "650-750° F.+ fractions". By contrast, "650-750° F. fractions" refers to a fraction with an unspecified initial cut point and an end point somewhere between 650° F. and 750° F. Waxy feeds may be processed as the entire fraction or as subsets of the entire fraction prepared by distillation or other separation techniques. The waxy feed also typically comprises more than 90%, generally more than 95% and preferably more than 98 wt % paraffinic hydrocarbons, most of which are normal paraffins. It has negligible amounts of sulfur and nitrogen compounds (e.g., less than 1 wppm of each), with less than 2,000 wppm, preferably less than 1,000 wppm and more preferably less than 500 wppm of oxygen, in the form of oxygenates. Waxy feeds having these properties and useful in the process of the invention have been made using a slurry F-T process with a catalyst having a catalytic cobalt component, as previously indicated.

The process of making the lubricant oil base stocks from waxy stocks, e.g., slack wax or F-T wax, may be characterized as an isomerization process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization or hydrodewaxing catalyst used in subsequent steps. If F-T waxes are used, such preliminary treatment is not required because, as indicated above, such waxes have only trace amounts (less than about 10 ppm, or more typically less than about 5 ppm to nil) of sulfur or nitrogen compound content. However, some hydrodewaxing catalyst fed F-T waxes may benefit from prehydrotreatment for the removal of oxygenates while others may benefit from oxygenates treatment. The hydroisomerization or hydrodewaxing process may be conducted over a combination of catalysts, or over a single catalyst. Conversion temperatures range from about 150° C. to about 500° C. at pressures ranging from about 500 to 20,000 kPa. This process may be operated in the presence of hydrogen, and hydrogen partial pressures range from about 600 to 6000 kPa. The ratio of hydrogen to the hydrocarbon feedstock (hydrogen circulation rate) typically range from about 10 to 3500 n.l.l.$^{-1}$ (56 to 19,660 SCF/bbl) and the space velocity of the feedstock typically ranges from about 0.1 to 20 LHSV, preferably 0.1 to 10 LHSV.

Following any needed hydrodenitrogenation or hydrodesulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Other isomerization catalysts and processes for hydrocracking, hydro-dewaxing, or hydroisomerizing GTL materials and/or waxy materials to base stock or base oil are described, for example, in U.S. Pat. Nos. 2,817,693; 4,900,407; 4,937,399; 4,975,177; 4,921,594; 5,200,382; 5,516,740; 5,182,248; 5,290,426; 5,580,442; 5,976,351; 5,935,417; 5,885,438; 5,965,475; 6,190,532; 6,375,830; 6,332,974; 6,103,099; 6,025,305; 6,080,301; 6,096,940; 6,620,312; 6,676,827; 6,383,366; 6,475,960; 5,059,299; 5,977,425; 5,935,416; 4,923,588; 5,158,671; and 4,897,178; EP 0324528 (B1), EP 0532116 (B1), EP 0532118 (B1), EP 0537815 (B1), EP 0583836 (B2), EP 0666894 (B2), EP 0668342 (B1), EP 0776959 (A3), WO 97/031693 (A1), WO 02/064710 (A2), WO 02/064711 (A1), WO 02/070627 (A2), WO 02/070629 (A1), WO 03/033320 (A1) as well as in British Patents 1,429,494; 1,350,257; 1,440,230; 1,390,359; WO 99/45085 and WO 99/20720. Particularly favorable processes are described in European Patent Applications 464546 and 464547. Processes using F-T wax feeds are described in U.S. Pat. Nos. 4,594,172; 4,943,672; 6,046,940; 6,475,960; 6,103,099; 6,332,974; and 6,375,830.

Hydrocarbon conversion catalysts useful in the conversion of the n-paraffin waxy feedstocks disclosed herein to form the isoparaffinic hydro-carbon base oil are zeolite catalysts, such as ZSM-5, ZSM-11, ZSM-23, ZSM-35, ZSM-12, ZSM-38, ZSM-48, offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one embodiment, conversion of the waxy feedstock may be conducted over a combination of Pt/zeolite beta and Pt/ZSM-23 catalysts in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over a catalyst comprising Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269. The use of the Group VIII metal loaded ZSM-48 family of catalysts, e.g., platinum on ZSM-48, in the hydroisomerization of the waxy feedstock eliminates the need for any subsequent, separate dewaxing step.

A dewaxing step, when needed, may be accomplished using one or more of solvent dewaxing, catalytic dewaxing or hydrodewaxing processes and either the entire hydroisomerate or the 650-750° F.+ fraction may be dewaxed, depending on the intended use of the 650-750° F.− material present, if it has not been separated from the higher boiling material prior to the dewaxing. In solvent dewaxing, the hydroisomerate may be contacted with chilled solvents such as acetone, methyl ethyl ketone (MEK), methyl isobutyl ketone (MIBK), mixtures of MEK/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Autorefrigerative dewaxing using low molecular weight hydrocarbons, such as propane, can also be used in which the hydroisomerate is mixed with, e.g., liquid propane, a least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention. Also well known is catalytic dewaxing, in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials, in the boiling range, for example, 650-750° F.−, which are separated from the heavier 650-750° F.+ base stock fraction and the base stock fraction fractionated into two or more base stocks. Separation of the lower boiling material may be accomplished either prior to or during fractionation of the 650-750° F.+ material into the desired base stocks.

Any dewaxing catalyst which will reduce the pour point of the hydroisomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400-600° F., a pressure of 500-900 psig, $H_2$ treat rate of 1500-3500 SCF/B for flow-through reactors and LHSV of 0.1-10, preferably 0.2-2.0. The dewaxing is typically conducted to convert no more than 40 wt % and preferably no more than 30 wt % of the hydroisomerate having an initial boiling point in the range of 650-750° F. to material boiling below its initial boiling point.

GTL base stock(s) and/or base oil(s), hydrodewaxed, or hydroisomerized/cat (or solvent) dewaxed wax-derived base stock(s) and/or base oil(s), have a beneficial kinematic viscosity advantage over conventional API Group II and Group III base stock(s) and/or base oil(s), and so may be very advantageously used with the instant invention. Such GTL base stock(s) and/or base oil(s) can have significantly higher kinematic viscosities, up to about 20-50 $mm^2/s$ at 100° C., whereas by comparison commercial Group II base oils can have kinematic viscosities up to about 15 $mm^2/s$ at 100° C., and commercial Group III base oils can have kinematic viscosities up to about 10 $mm^2/s$ at 100° C. The higher kinematic viscosity range of GTL base stock(s) and/or base oil(s), compared to the more limited kinematic viscosity range of Group II and Group III base stock(s) and/or base oil(s), in combination with the instant invention can provide additional beneficial advantages in formulating lubricant compositions.

In the present invention one or a mixtures of hydrodewaxate(s), or hydroisomerate/cat (or solvent) dewaxate(s) base stock(s) and/or base oil(s), one or more mixtures of the GTL base stock(s) and/or base oil(s), or mixtures thereof, preferably mixtures of GTL base stock(s) and/or base oil(s), can constitute part of the base oil. Such base stock(s) and/or base oil(s) can be used in further combination with one or more other base stock(s) and/or base oil(s) of mineral oil origin, natural oils and/or with synthetics.

The preferred base stock(s) and/or base oil(s) derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

A preferred GTL liquid hydrocarbon composition is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geqq 4$), are such that: (a) $BI-0.5(CH_2 \geqq 4)>15$; and (b) $BI+0.85\ (CH_2 \geqq 4)<45$ as measured over said liquid hydrocarbon composition as a whole.

The preferred GTL base stock and/or base oil can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred $BI \geqq 25.4$ and $(CH_2 \geqq 4) \leqq 22.5$. They have a nominal boiling point of 370° C.$^+$, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula: DV (at −40° C.)<2900 (KV at 100° C.)−7000.

The preferred GTL base stock and/or base oil is also characterized as comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2 \geqq 4$), and Free Carbon Index (FCI) are determined as follows:

Branching Index

A 359.88 MHz 1H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;
6.2-4.0 ppm hydrogens on olefinic carbon atoms;
4.0-2.1 ppm benzylic hydrogens at the α-position to aromatic rings;
2.1-1.4 ppm paraffinic CH methine hydrogens;
1.4-1.05 ppm paraffinic $CH_2$ methylene hydrogens;
1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geqq 4$)

A 90.5 MHz$^3$CMR single pulse and 135 Distortionless Enhancement by Polarization Transfer (DEPT) NMR spectra are obtained on a Brucker 360 MHz AMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at =29.8 ppm is due to equivalent recurring methylene carbons which are four or more removed from an end group or branch (CH2>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a) calculate the average carbon number of the molecules in the sample which is accomplished with sufficient accuracy for lubricating oil materials by simply dividing the molecular weight of the sample oil by 14 (the formula weight of $CH_2$);
b) divide the total carbon-13 integral area (chart divisions or area counts) by the average carbon number from step a. to obtain the integral area per carbon in the sample;
c) measure the area between 29.9 ppm and 29.6 ppm in the sample; and
d) divide by the integral area per carbon from step b. to obtain FCI.

Branching measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH and the methyls are clearly identified by chemical shift and phase. The branching properties of each sample are determined by C-13 NMR using the assumption in the calculations that the entire sample is isoparaffinic. Corrections are not made for n-paraffins or cycloparaffins, which may be present in the oil samples in varying amounts. The cycloparaffins content is measured using Field Ionization Mass Spectroscopy (FIMS).

GTL base stock(s) and/or base oil(s), and hydrodewaxed, or hydroisomerized/cat (or solvent) dewaxed wax base stock (s) and/or base oil(s), for example, hydroisomerized or hydrodewaxed waxy synthesized hydrocarbon, e.g., Fischer-Tropsch waxy hydrocarbon base stock(s) and/or base oil(s) are of low or zero sulfur and phosphorus content. There is a movement among original equipment manufacturers and oil formulators to produce formulated oils of ever increasingly reduced sulfated ash, phosphorus and sulfur content to meet ever increasingly restrictive environmental regulations. Such oils, known as low SAPS oils, would rely on the use of base oils which themselves, inherently, are of low or zero initial sulfur and phosphorus content. Such oils when used as base oils can be formulated with additives. Even if the additive or additives included in the formulation contain sulfur and/or phosphorus the resulting formulated lubricating oils will be lower or low SAPS oils as compared to lubricating oils formulated using conventional mineral oil base stock(s) and/or base oil(s).

For example, low SAPS formulated oils for vehicle engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

The lubricating oil comprising the synthetic phenol ether can be used as is or more typically in combination with one or more second base oils described above and/or with one or more performance additives.

Examples of typical performance additives include, but are not limited to, oxidation inhibitors, antioxidants, dispersants, detergents, corrosion inhibitors, rust inhibitors, metal deactivators, anti-wear agents, extreme pressure additives, anti-seizure agents, pour point depressants, wax modifiers, other viscosity index improvers, other viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in "Lubricants and Related Products", Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

Finished lubricants usually comprise the lubricant base stock or base oil, plus at least one performance additive.

The types and quantities of performance additives used in combination with the instant invention in lubricant compositions are not limited by the examples shown herein as illustrations.

Antiwear and EP Additives

Many lubricating oils require the presence of antiwear and/or extreme pressure (EP) additives in order to provide adequate antiwear protection. Increasingly specifications for lubricant performance, e.g., engine oil performance, have exhibited a trend for improved antiwear properties of the oil. Antiwear and extreme EP additives perform this role by reducing friction and wear of metal parts.

While there are many different types of antiwear additives, for several decades the principal antiwear additive for internal combustion engine crankcase oils is a metal alkylthiophosphate and more particularly a metal dialkyldithiophosphate in which the primary metal constituent is zinc, or zinc dialkyldithiophosphate (ZDDP). ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lube oil composition, although more or less can often be used advantageously.

However, it is found that the phosphorus from these additives has a deleterious effect on the catalyst in catalytic converters and also on oxygen sensors in automobiles. One way to minimize this effect is to replace some or all of the ZDDP with phosphorus-free antiwear additives.

A variety of non-phosphorous additives are also used as antiwear additives. Sulfurized olefins are useful as antiwear and EP additives. Sulfur-containing olefins can be prepared by sulfurization of various organic materials including aliphatic, arylaliphatic or alicyclic olefinic hydrocarbons containing from about 3 to 30 carbon atoms, preferably 3-20 carbon atoms. The olefinic compounds contain at least one non-aromatic double bond. Such compounds are defined by the formula $$R^3R^4C{=}CR^5R^6$$

where each of $R^3$-$R^6$ are independently hydrogen or a hydrocarbon radical. Preferred hydrocarbon radicals are alkyl or alkenyl radicals. Any two of $R^3$-$R^6$ may be connected so as to form a cyclic ring. Additional information concerning sulfurized olefins and their preparation can be found in U.S. Pat. No. 4,941,984, incorporated by reference herein in its entirety.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds in combination with a molybdenum compound (oxymolybdenum diisopropyl-phosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithiocarbamate trimer complex ($R{=}C_8$-$C_{18}$ alkyl) are also useful antiwear agents. The use or addition of such materials should be kept to a minimum if the object is to produce low SAP formulations.

Esters of glycerol may be used as antiwear agents. For example, mono-, di-, and tri-oleates, mono-palmitates and mono-myristates may be used.

ZDDP is combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties.

Preferred antiwear additives include phosphorus and sulfur compounds such as zinc dithiophosphates and/or sulfur, nitrogen, boron, molybdenum phosphorodithioates, molybdenum dithiocarbamates and various organomolybdenum derivatives including heterocyclics, for example dimercaptothiadiazoles, mercaptobenzothiadiazoles, triazines, and the like, alicyclics, amines, alcohols, esters, diols, triols, fatty amides and the like can also be used. Such additives may be used in an amount of about 0.01 to 6 wt %, preferably about 0.01 to 4 wt %. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAP formulations.

Viscosity Index Improvers

Viscosity index improvers (also known as VI improvers, viscosity modifiers, and viscosity improvers) provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between about 10,000 to 1,000,000, more typically about 20,000 to 500,000, and even more typically between about 50,000 and 200,000.

Examples of suitable viscosity index improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), which also serve as pour point depressants in some formulations. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Viscosity index improvers may be used in an amount of about 0.01 to 8 wt %, preferably about 0.01 to 4 wt %.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in "Lubricants and Related Products", op cite, and U.S. Pat. Nos. 4,798,684 and 5,084,197, for example.

Useful antioxidants include hindered phenols. These phenolic anti-oxidants may be ashless (metal-free) phenolic compounds or neutral or basic metal salts of certain phenolic compounds. Typical phenolic antioxidant compounds are the hindered phenols which are the phenols which contain a sterically-hindered hydroxy group, and these include those derivatives of dihydroxy aryl compounds in which the hydroxy groups are in the ortho- or para-position relative to each other. Typical phenolic antioxidants include the hindered phenols substituted with $C_4$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptylphenol; 2,6-di-t-butyl-4-dodecylphenol; 2-methyl-6-t-butyl-4-heptylphenol; and 2-methyl-6-t-butyl-4-dodecylphenol. Other useful hindered mono-phenolic antioxidants may include, for example, the hindered 2,6-di-alkylphenolic proprionic ester derivatives. Bis-phenolic antioxidants may also be advantageously used in combination with the instant invention. Examples of ortho-coupled bisphenols include: 2,2'-bis(4-heptyl-6-t-butylphenol); 2,2'-bis(4-octyl-6-t-butylphenol); and 2,2'-bis(4-dodecyl-6-t-butylphenol). Para-coupled bisphenols include for example 4, 4'-bis(2,6-di-t-butylphenol) and 4,4'-methylene-bis(2,6-di-t-butylphenol).

Non-phenolic oxidation inhibitors which may be used include aromatic amine antioxidants and these may be used either as such or in combination with phenolic antioxidants. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine anti-oxidants useful in the present invention include: p,p'-dioctyldiphenylamine; t-octylphenyl-alpha-naphthylamine; phenyl-alpha-naphthylamine; and p-octylphenyl-alpha-naphthylamine.

Sulfurized alkylphenols and alkali or alkaline earth metal salts thereof also are useful antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio- or dithio-phosphates and copper salts of naturally occurring or synthetic carboxylic acids. Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Preferred antioxidants include hindered phenols or arylamines. These antioxidants may be used individually by type or in combination with one another. Such additives may be used in an amount of about 0.01 to 5 wt %, preferably about 0.01 to 1.5 wt %.

Detergents

Detergents are commonly used in lubricating compositions. A typical detergent is an anionic material that contains a long chain hydrophobic portion of the molecule and a smaller oleophobic anionic or hydrophilic portion of the molecule. The anionic portion of the detergent is typically derived from an organic acid such as a sulfur acid, carboxylic acid, phosphorus acid, phenol, or mixtures thereof. The counterion is typically an alkaline earth or alkali metal.

Salts that contain a substantially stoichiometric amount of the metal are described as neutral salts and have a total base number (TBN, as measured by ASTM D2896) of from 0 to about 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl-substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 or more carbon atoms, more typically from about 16 to 60 carbon atoms.

Klamann in "Lubricants and Related Products", op cit, discloses a number of overbased metal salts of various sulfonic acids which are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates that are useful as dispersants and/or detergents.

Alkaline earth phenates are another useful class of detergent for lubricants. These detergents can be made by reacting alkaline earth metal hydroxide or oxide (CaO, $Ca(OH)_2$, BaO, $Ba(OH)_2$, MgO, $Mg(OH)_2$, for example) with an alkylphenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur or sulfur halides, such as sulfur dichloride, and the like) and then reacting the sulfurized phenol with an alkaline earth metal hydroxide or oxide.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

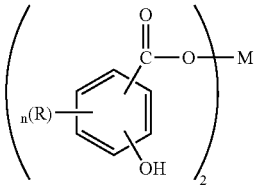

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably calcium, magnesium, or barium. More preferably, M is calcium.

Hydrocarbyl-substituted salicylic acids may be prepared from phenols by the Kolbe reaction. See U.S. Pat. No. 3,595,791, for additional information on synthesis of these compounds. The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039 for example.

Preferred detergents include calcium phenates, calcium sulfonates, calcium salicylates, magnesium phenates, magnesium sulfonates, magnesium salicylates and other related components (including borated detergents). Typically, the total detergent concentration is about 0.01 to about 6.0 wt %, preferably, about 0.1 to 0.4 wt %.

Dispersant

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So-called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-aminoalkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, penta-propylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also known as paraformaldehyde and formalin), acetaldehyde and aldol (β-hydroxybutyraldehyde). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn from about 500 to about 5000 or a mixture of such hydrocarbylene groups. Other preferred dispersants include succinic acid-esters and amides, alkylphenolpolyamine-coupled Mannich adducts, their capped derivatives, and other related components. Such additives may be used in an amount of about 0.1 to 20 wt %, preferably about 0.1 to 8 wt %.

Pour Point Depressants

Conventional pour point depressants (also known as lube oil flow improvers) may be added to the compositions of the present invention if desired. These pour point depressant may be added to lubricating compositions of the present invention to lower the minimum temperature at which the fluid will flow or can be poured. Examples of suitable pour point depressants include alkylated naphthalene, polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Such additives may be used in an amount of about 0.01 to 5 wt %, preferably about 0.01 to 1.5 wt %.

Corrosion Inhibitors

Corrosion inhibitors are used to reduce the degradation of metallic parts that are in contact with the lubricating oil composition. Suitable corrosion inhibitors include thiadiazoles. See, for example, U.S. Pat. Nos. 2,719,125; 2,719,126; and 3,087,932, which are incorporated herein by reference in their entirety. Such additives may be used in an amount of about 0.01 to 5 wt %, preferably about 0.01 to 1.5 wt %.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt %.

Anti-Foam Agents

Anti-foam agents may advantageously be added to lubricant compositions. These agents retard the formation of stable foams. Silicones and organic polymers are typical antifoam agents. For example, polysiloxanes, such as silicon oil or polydimethyl siloxane, provide antifoam properties. Antifoam agents are commercially available and may be used in conventional minor amounts along with other additives such as demulsifiers; usually the amount of these additives combined is less than 1 percent and often less than 0.1 percent.

Inhibitors and Antirust Additives

Antirust additives (or corrosion inhibitors) are additives that protect lubricated metal surfaces against chemical attack by water or other contaminants. A wide variety of these are commercially available; they are referred to in Klamann in "Lubricants and Related Products", op cit.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 wt %, preferably about 0.01 to 1.5 wt %.

Friction Modifiers

A friction modifier is any material or materials that can alter the coefficient of friction of a surface lubricated by any lubricant or fluid containing such material(s). Friction modifiers, also known as friction reducers, lubricity agents, or oiliness agents, and other such agents that change the ability of base oils, formulated lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partially esterified glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective, as for example Mo-dithiocarbamates, Mo(DTC), Mo-dithiophosphates, Mo(DTP), Mo-amines, Mo (Am), Mo-alcoholates, Mo-alcohol-amides, etc. See U.S. Pat. Nos. 5,824,627; 6,232,276; 6,153,564; 6,143,701; 6,110,878; 5,837,657; 6,010,987; 5,906,968; 6,734,150; 6,730,638; 6,689,725; 6,569,820; WO 99/66013; WO 99/47629; WO 98/26030.

Ashless friction modifiers may also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing fatty carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 to 10-15 wt % or more, often with a preferred range of about 0.1 to 5 wt %. Concentrations of molybdenum-containing friction modifiers are often described in terms of Mo metal concentration. Advantageous concentrations of Mo may range from about 10 to 3000 ppm or more, and often with a preferred range of about 20 to 2000 ppm, and in some instances a more preferred range of about 30 to 1000 ppm. Friction modifiers of all types may be used alone or in mixtures with the materials of this invention. Often mixtures of two or more friction modifiers, or mixtures of friction modifier(s) with alternate surface active material(s), are also desirable.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table 1 below.

Note that many of the additives are shipped from the manufacturer and used with a certain amount of a base oil diluent in the formulation. Accordingly, the weight amounts in the table below, as well as other amounts mentioned in this text, are directed to the amount of active ingredient (that is the non-diluent/diluent portion of the ingredient) unless otherwise indicated. The weight percent indicated below are based on the total weight of the lubricating oil composition.

TABLE 1

Typical Amounts of Various Lubricant Oil Components

| Compound | Approximate Wt % (Useful) | Approximate Wt % (Preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Viscosity Index Improver | 0.0-40 | 0.01-30, more preferably 0.01-15 |
| Antioxidant | 0.0-5 | 0.0-1.5 |
| Corrosion Inhibitor | 0.01-5 | 0.01-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base Oil | Balance | Balance |

Lubricating oils of the present invention utilizing hydroxy phenol ethers either as the only base stock or preferably in combination with a second base stock as described above comprise both straight grade and multigrade lubricating oil formulations such as SAE 0W-X, 5W-X and 10W-X where X ranges from 10 to 50, preferably 20 to 40.

The present invention is further described by the following non-limiting examples and comparisons with the Comparative examples.

Example 1

Potassium hydroxide (150 g, 85% purity) and tetrabutylammonium bromide (10 g) were dissolved in water (150 mL) in a three-neck 2 L round bottom flask, equipped with a mechanical stirrer, and a condenser. The bisphenol A (228 g, 1 mole) was added to the reaction mixture, and the stirring continued at 70° C. (oil bath temperature) under nitrogen until almost all bisphenol A has dissolved (approximately 1 hour). The reaction flask was equipped with an addition funnel (500 mL with pressure equalizing line), and a mixture of butyl bromide (53.8 mL, 0.5 mole), n-hexyl bromide (70.2 mL, 0.5 mole), n-octyl bromide (86.9 mL, 0.5 mole) and 2-ethylhexyl bromide (89.35 mL, 0.5 mole) was added to the reaction mixture at 70° C. during 1 hour period under nitrogen. The reaction mixture was stirred at 70° C. for another 20 hours. After cooling to room temperature, the resulting liquid washed 4 times (200 mL, 3×100 mL) with water in a 2-L separatory funnel. The remaining water and unreacted alkyl bromides were removed at 160° C., 1 mm Hg. It took about 2 hours to reach these conditions. The mixture was maintained at 160° C./1 mm Hg for another 5 to 6 hours to remove residual volatiles. The remaining liquid was filtered through a 2 cm layer of neutral alumina using a 500 mL Buckner funnel and under vacuum (10-15 mm Hg) to yield about 325 g of a colorless liquid.

Example 2

The hydroxy phenolic ether bisphenolalkylether (BPAE) of Example 1 was tested for oxidation stability by the RPVOT (Rotary Pressure Vessel Oxidation Test). This is a standard ASTM D 2272 test performed at 150° C. The test method is also used to assess the remaining oxidation test life of in-service oils. The various aromatic base stocks shown below also were tested by RPVOT without addition of any antioxidants. The results show the outstanding performance of the BPAE of this invention.

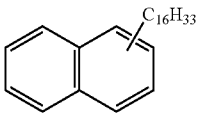

AN

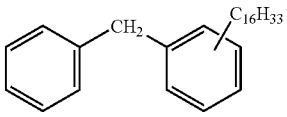

ADPM

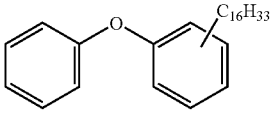

ADPO

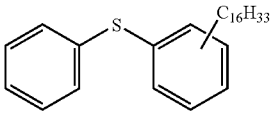

ADPS

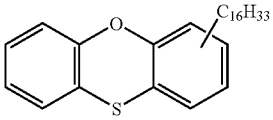

ASDPO

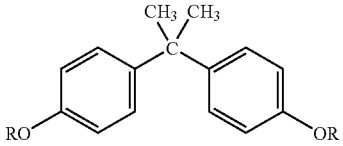

BPAE

R = $C_4$-$C_8$ mixtures

| Properties | AN | ADPM | ADPO | ADPS | ASDPO | BPAE |
|---|---|---|---|---|---|---|
| RPVOT, mins | 150 | 50 | 120 | 512 | 420 | 1439 |

Example 3

This Example shows that the Bisphenol A ethers (BPAE) have excellent solvency property as characterized by the low aniline point (ASTM D 611). The lower the aniline point, the better is the solvency characteristic. The results are compared with others aromatic base stocks.

TABLE 2

| Properties | AN | ADPM | ADPO | ADPS | BPAE |
|---|---|---|---|---|---|
| Aniline Point, ° C. (ASTM D611) | 33 | 9.7 | 5.3 | 9.2 | <0 |

Example 4

The Noack volatility was determined by ASTM D 5800-B and the results compared with other aromatic base stocks. The lower the weight percent loss, the lower is the volatility. The results in the following Table 3 show that BPAE have desirable low volatility.

TABLE 3

| Properties | AN | ADPM | ADPO | ADPS | ASDPO | BPAE |
|---|---|---|---|---|---|---|
| Noac Volatility, wt % ASTM D 5800 | 11.2 | 12.6 | 10.0 | 4.5 | 7.1 | 4.0 |

Example 5

The oxidative stability of Bisphenol A ether (BPAE) in the presence of catalytic metals was assessed. The heated (325° F.) base stock was subjected to a stream of air which was bubbled through the liquid at a rate of 5-L/hour for 40 hours. Coupons of metals commonly used in engine construction, namely iron, copper, aluminum and lead were added to the liquid prior to the test. The following results show that the BPAE produced no sludge. The viscosity and the acid number of the post-test oil are measured. The sludge is determined by filtration of the post-test oil. The viscosity increase after the test was very low and did not produce acidic material that was corrosive to lead.

TABLE 4

| Properties | AN | ADPM | ADPO | ADPS | ASDPO | BPAE |
|---|---|---|---|---|---|---|
| B-10 (M-334) 325° F., 40 hours | | | | | | |
| % Viscosity @ 100° C., Increase | 10 | 342 | 103 | 14 | 5 | 4 |
| Acid Number | 1.0 | 13.4 | 9 | 1.7 | 0.5 | 0.4 |
| Sludge | Light | Nil | Moderate | Heavy | Light | Nil |
| % Lead Loss | 10 | 37 | 48 | 13 | 5 | 2 |

Example 6

This Example shows that addition of 20 wt % bisphenol A ethers of this invention reduce the pour point (ASTM D97) of the GTL base oil, non-linearly, by 12° C., whereas a comparative ester base oil, Ketjenlube K19, which is the reaction product of maleic esters with an alphaolefin that has a pour point of −54° C. did not significantly reduce the pour point of the GTL base oil.

TABLE 5

| | | | | | |
|---|---|---|---|---|---|
| K19, wt % | 100 | 0 | 5 | 20 | 60 |
| GTL 6, wt % | 0 | 100 | 95 | 80 | 40 |
| Pour Point, ° C. | −54 | −18 | −21 | −21 | −24 |
| BPAE, wt % | 100 | 0 | 5 | 20 | 60 |
| GTL 6, wt % | 0 | 100 | 95 | 80 | 40 |
| Pour Point, ° C. | −39 | −18 | −21 | −30 | −30 |

Example 7

This Example illustrates the excellent solvency properties of the BPAE as determined by the aniline point (ASTM D611). With decreasing aniline point, the solvency properties increase. Addition of 5 and 20 wt % BPAE to the GTL lube oil brings the solvency properties to a level similar to a Bright Stock and SN 600 base stock respectively without significantly increasing the base oil viscosity.

TABLE 6

| Base Oil | KV @ 40° C., cSt | KV @ 100° C., cSt | Aniline Point, ° C. | Pour Point, ° C. |
|---|---|---|---|---|
| GTL 6 | 29.68 | 6.05 | 129.3 | −18 |
| GTL 6 + 5% BPAE | 30.5 | 6.1 | 125.9 | −21 |
| GTL 6 + 20% BPAE | 33.0 | 6.1 | 114.8 | −30 |
| SN 600 | 115.3 | 12.2 | 113.4 | −12 |
| Bright Stock | 487.8 | 31.8 | 123.1 | −6 |

Example 8

In this Example synthetic lubricant (5W-30) compositions were formulated with Group III base stock, polyalphaolefins, trimethylol propane (TMP), and additives (Fluid 1 and 1A), Group III base stocks, polyalphaolefins, alkylated naphthalene and additives (Fluid 2 and 2A), and Group III bas stock polyalphaolefins, BPAE and additives (Fluid 3 and 3A). The additive and co-base stock treat rates were kept consistent in all comparative cases. The compositional profiles of the fluids are presented in Table 7 below. Table 8 below shows that the BPAE of this invention gave similar seal compatibility performance to the alkylated naphthalene and better than (TMP).

TABLE 7

| | Fluid 1 wt % | Fluid 1A Wt % | Fluid 2 wt % | Fluid 2A wt % | Fluid 3 wt % | Fluid 3A wt % |
|---|---|---|---|---|---|---|
| PAO | 39.2 | 35.1 | 39.2 | 35.1 | 39.2 | 35.1 |
| Group III base stock | 34.0 | 30.4 | 34.0 | 30.4 | 34.0 | 30.4 |
| Additives* | 21.8 | 19.5 | 21.8 | 19.5 | 21.8 | 19.5 |
| TMP | 5.0 | 15.0 | | | | |
| AN | | | 5.0 | 15.0 | | |
| BPAE | | | | | 5.0 | 15.0 |

*a mixture of dispersants, viscosity index improvers, detergents, antiwear additives, antioxidants, friction modifiers and an antifoamant and a seal protection additive.

TABLE 8

| Fluid | 1 TMP Ester | 1A TMP Ester | 2 AN | 2A AN | 3 BPAE | 3A BPAE | Limits |
|---|---|---|---|---|---|---|---|
| VW503 Seal Test (PV 3344 issued 10/98) (elastomer-polyacrylate ester) | | | | | | | |
| Change of Tensile Strength, % | 9.5 | 7.6 | 8.6 | 9.5 | 13 | 11 | ≧−40 |
| Change of Elongation at Break, % | −24 | −21 | −19 | −22 | −20 | −14 | ≧−40 |
| Change of Shore-A Hardness | 0 | −2 | 3 | 0 | 3 | 0 | −4 to 10 |
| Change of Weight, % | 1.8 | 3.6 | 1.5 | 2.6 | 2.4 | 2.3 | −2 to 6 |
| VW503 (PV 3344, issued 10/98) elastomer-ethylene acrylic VAMAC | | | | | | | |
| Change of Tensile Strength, % | −12 | −16 | −9.1 | −14 | −7.4 | −16 | ≧−40 |
| Change of Elongation at Break, % | −20 | −12 | −24 | −16 | −25 | −25 | ≧−40 |
| Change of Shore-A Hardness | −2 | −5 | 0 | −2 | 1 | −4 | −4 to 10 |
| Change of Weight, % | 9.1 | 14.7 | 8.2 | 12.2 | 8.8 | 15.2 | −3 to 15 |
| DC (MB) Seal Test VDA 675301 DIN 53538 Elastomer-NRB-34 (Nitrile) | | | | | | | |
| Tensile Strength - Variation Relative | −21.4 | −22.2 | −20.6 | −16.7 | −18.7 | | −20.0 Min |
| Elongation Break - Variation Relative | −39.8 | −36.2 | −42.4 | −38.9 | −41.8 | | −35.0 Min |
| Shore-A Hardness - Variation Absolute | −2 | −2 | 1 | 0 | −2 | | −8 to 2 |
| Relative Volume Change (average) | 2.5 | 2.7 | 1.9 | 3.1 | 2.5 | | 0 to 10.0 |

What is claimed is:

1. A method for improving the pour point performance of a lubricating oil base oil selected from the group consisting of mineral oil, synthetic oil and non-conventional oil and mixtures thereof by adding to the base oil about 20 wt % of a synthetic phenolic ether of the formula:

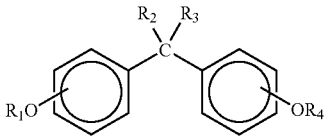

wherein $R_1$ and $R_4$ are the same or different and are hydrogen or alkyl hydrocarbyl groups containing 1 to 16 carbons provided that both $R_1$ and $R_4$ cannot be H and that if either is H it constitutes less than 5% of the total of the $R_1$ and $R_4$ group; $R_2$ and $R_3$ are the same or different and are hydrogen or $C_1$-$C_3$ alkyl, wherein the pour point performance improvement is the non-linear reduction of the pour point of the lubricating oil.

2. The method of claim 1 wherein $R_1$ and $R_4$ are the same or different and are hydrogen or $C_3$ to $C_{16}$ linear or branched alkyl groups.

3. The method of claim 1 wherein $R_1$ and $R_4$ are the same or different and are hydrogen or $C_3$ to $C_{12}$ linear or branched alkyl groups.

4. The method of claim 1 wherein $R_2$ and $R_3$ are methyl.

5. The method of claim 1 wherein $R_1$ and $R_4$ are different.

6. The method of claim 4 wherein $R_1$ and $R_4$ are different.

7. The method of claim 1 wherein the lubricating oil base oil is one or more GTL base stock and/or base oil and/or hydrodewaxed or hydroisomerized/catalytic (and/or solvent) dewaxed waxy feed base stock and/or base oil.

* * * * *